US007829010B2

(12) United States Patent
Schwadron et al.

(10) Patent No.: US 7,829,010 B2
(45) Date of Patent: Nov. 9, 2010

(54) GUIDE TUBE END-PIECE, ASSEMBLY AND METHOD

(75) Inventors: James Timothy Schwadron, Valencia, PA (US); Leslie Wade Niemi, Davenport, IA (US); Gregory P. Marzec, East Amherst, NY (US)

(73) Assignee: Affival, Inc., Williamsville, NY (US)

( * ) Notice: Subject to any disclaimer, the term of this patent is extended or adjusted under 35 U.S.C. 154(b) by 358 days.

(21) Appl. No.: 11/367,492

(22) Filed: Mar. 4, 2006

(65) Prior Publication Data

US 2006/0216447 A1 Sep. 28, 2006

Related U.S. Application Data

(60) Provisional application No. 60/658,660, filed on Mar. 4, 2005.

(51) Int. Cl.
*C21C 7/00* (2006.01)

(52) U.S. Cl. ..... 266/44; 266/216; 222/606

(58) Field of Classification Search ..... 266/216, 266/217, 270, 268, 265, 44; 222/606
See application file for complete search history.

(56) References Cited

U.S. PATENT DOCUMENTS

| | | | | |
|---|---|---|---|---|
| 2,577,837 | A * | 12/1951 | Zifferer | 266/216 |
| 3,367,646 | A | 2/1968 | Robertson et al. | |
| 3,650,516 | A * | 3/1972 | Mantell et al. | 266/216 |
| 3,942,775 | A * | 3/1976 | LaBate | 266/216 |
| 4,066,248 | A | 1/1978 | Hoffmeister et al. | |
| 4,093,193 | A | 6/1978 | Cassidy et al. | |
| 4,247,324 | A * | 1/1981 | Guarino et al. | 266/216 |
| 4,268,017 | A * | 5/1981 | Cole | 266/265 |
| 4,489,473 | A * | 12/1984 | Nakagami | 29/451 |
| 4,572,487 | A * | 2/1986 | Slagley | 266/270 |
| 4,617,171 | A | 10/1986 | Feutrel | |
| 4,705,261 | A * | 11/1987 | Wirth, Jr. | 266/216 |
| 4,881,824 | A | 11/1989 | Falk et al. | |
| 5,014,561 | A | 5/1991 | Falk et al. | |
| 5,765,730 | A * | 6/1998 | Richter | 222/590 |
| 5,772,324 | A | 6/1998 | Falk | |
| 5,948,350 | A | 9/1999 | Falk | |
| 5,975,755 | A | 11/1999 | Roberson | |

FOREIGN PATENT DOCUMENTS

| | | |
|---|---|---|
| EP | 1 087 025 A1 | 3/2001 |
| EP | 06 73 6957 | 11/2008 |
| GB | 1 274 618 A | 5/1972 |
| JP | 4-333510 | 11/1992 |
| JP | 04333510 | 11/1992 |
| WO | PCT/US06/07718 | 9/2007 |

* cited by examiner

*Primary Examiner*—Scott Kastler
(74) *Attorney, Agent, or Firm*—Hodgson Russ LLP

(57) ABSTRACT

An end-piece for an additive guide tube is disclosed. Such an end piece may have a durable sleeve and a sloughable sleeve. The sloughable sleeve may have a channel through which an additive may be delivered, and the sloughable sleeve may reside in the through-hole of the durable sleeve and may be secured to the durable sleeve. When molten metal contacts the sloughable sleeve, the sloughable sleeve burns or melts and sloughs off, thereby preventing the molten metal and slag from sticking to the end-piece, which in turn prevents buildup of metal and slag.

2 Claims, 7 Drawing Sheets

GUIDE TUBE END-PIECE, ASSEMBLY AND METHOD

CROSS-REFERENCE TO RELATED APPLICATION

This application claims the benefit of priority to U.S. provisional patent application Ser. No. 60/658,660, filed on Mar. 4, 2005.

FIELD OF THE INVENTION

The present invention relates to devices and methods associated with injecting additives into molten metal.

BACKGROUND OF THE INVENTION

Injection of additives into molten metal baths is often accomplished by encasing the additives in a metal jacket or sheath to form a "cored wire," and then adding the cored wire to the molten metal bath, where the metal jacket or the sheath component of the wire melts and releases the additives. For example, an additive that may be added to steel is calcium. The calcium may be provided in the form of a wire that is insulated with paper and an additional jacket/sheath of steel.

To add a cored wire to a metal bath, a feeder (often referred to as an "injector") is used. The feeder pulls cored wire from a reel or cage, straightens the wire and pushes the straightened wire through a metal guide tube. A guide tube is generally a steel tube having a diameter between 25 millimeters and 150 millimeters, depending on equipment conditions. Often, recovery is best when the guide tube diameter is on the lower end of the range, for example, between 25 millimeters and 50 millimeters. The metal guide tube directs the cored wire on a trajectory so that the cored wire enters the molten metal bath to facilitate dissolving the cored wire in the molten metal.

For example, calcium is very reactive, has a low density relative to molten steel and forms a vapor at molten steel temperatures if it dissolves near the surface of the molten steel. To direct the wire deep into the metal bath, and thereby guard against dissolving near the surface of the molten steel bath, a guide tube may be used that is able to be positioned near the molten steel and survive the splashing of molten steel and slag while the calcium-cored wire is added to the molten steel. Usually, the cored wire is added to the molten steel for three to four minutes.

It has been shown that when the guide tube is placed close to the surface of the molten metal, more of the additive ends up in the molten metal. The "recovery" is the amount of additive measured in the molten metal divided by the amount of additive injected into the molten metal. Several factors determine the recovery of the additive. In almost all cases, greater recovery is desired. Factors which influence the recovery include the cored wire's angle of entry into the metal bath, the velocity at which the cored wire enters the metal bath, and the distance between the tip of the guide tube and the surface of the metal bath.

Recovery is usually improved if an end of the guide tube is placed close to the metal bath. However, experience shows that the end of the guide tube will be removed either by melting or oxidizing the guide tube, or the guide tube will become plugged if the guide tube is brought too close to the metal bath. Melting, oxidation and/or plugging have been observed when the distance between the guide tube and the metal bath is less than one meter. To avoid these conditions, a large, dense ceramic end-piece may be used on the end nearest the molten metal. However, such an end-piece is susceptible to metal and slag build-up on the ceramic end. Further, the weight of the end-piece makes handling difficult. In addition, build-up ultimately blocks the guide tube if the tube is lowered near the metal bath.

Consequently, there is a need for a new device that is able to withstand the temperatures and splashing of slag and metal, while reducing buildup, and at the same time is able to withstand mechanical abrasion and impact energy from the wire that is being added to the molten metal bath.

SUMMARY OF THE INVENTION

The invention may be embodied as an end-piece for an additive guide tube. Such an end piece may have a durable sleeve and a sloughable sleeve. The durable sleeve may have a first end and a second end, and an inner surface defining a through-hole extending from the first end to the second end. The sloughable sleeve may have a channel through which an additive may be delivered, and the sloughable sleeve may reside in the through-hole of the durable sleeve and may be secured to the durable sleeve.

The invention may be embodied as a guide tube assembly. Such a guide tube assembly may include a guide tube and an end-piece.

The invention may be embodied as a method. In one such method, a guide-tube assembly is provided. The guide tube assembly may have (a) a durable sleeve having a receiving end and a dispensing end, and having an inner surface defining a through-hole extending from the receiving end to the dispensing end, (b) a sloughable sleeve having a channel through which an additive may be delivered, the sloughable sleeve residing in the through-hole of the durable sleeve and being secured to the durable sleeve, and (c) an additive guide tube residing in the channel of the sloughable sleeve and being secured to the sloughable sleeve. The durable sleeve may be positioned proximate to molten metal, and an additive may be provided to the molten metal by feeding the additive through the sleeves from the receiving end toward the dispensing end.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
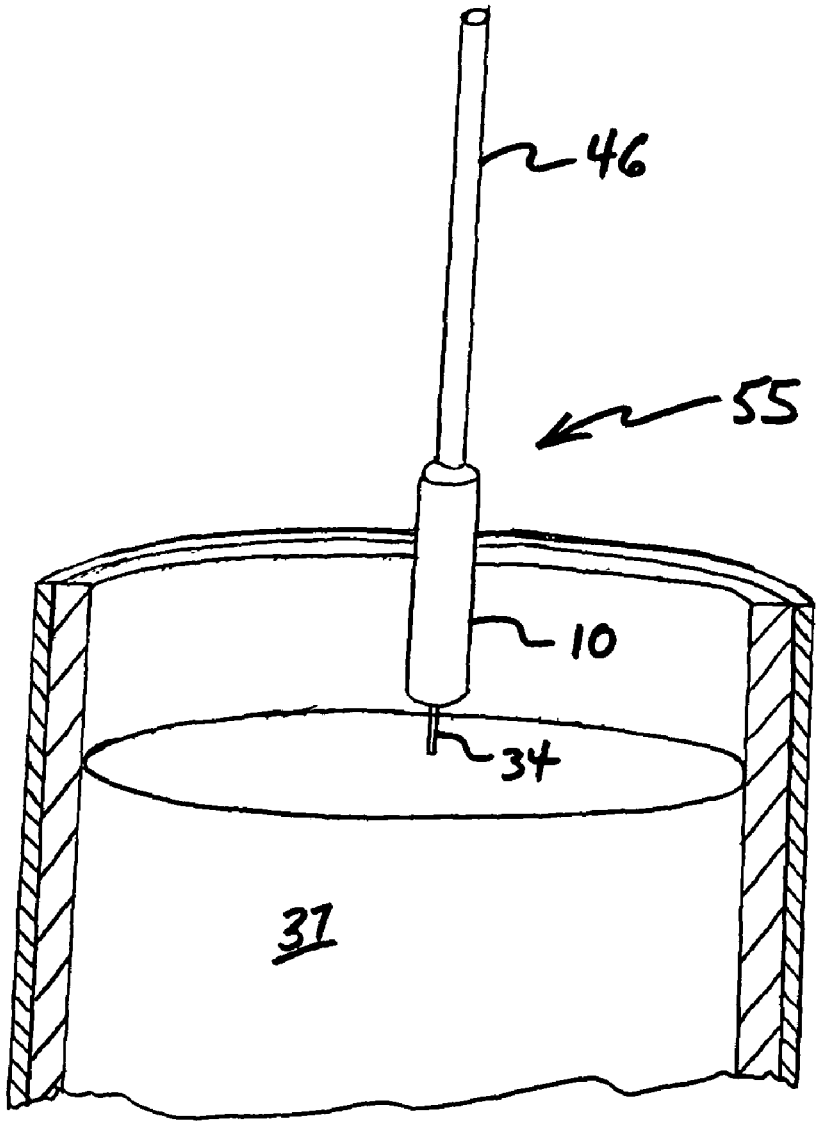
FIG. 1, which is a partially cross-sectioned perspective view of a guide tube assembly according to the invention being used on a guide tube to feed cored wire into molten metal.
Figure 2:
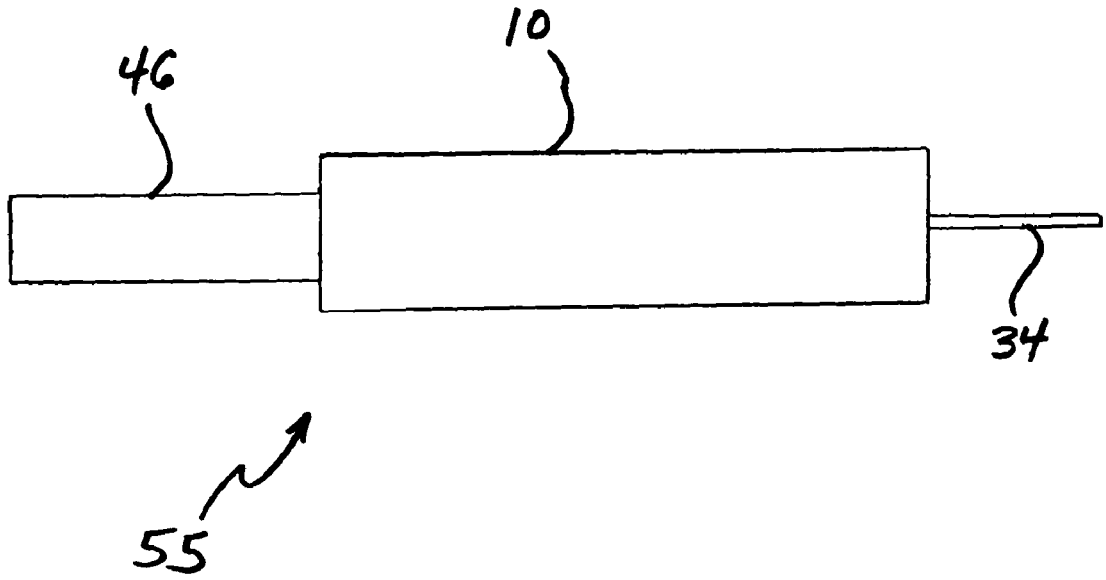
FIG. 2, which is a side view of an end-piece according to the invention.

The invention may be embodied as an end-piece 10 for an additive guide tube 46. FIGS. 1 through 4 depict one such end-piece 10. The end-piece 10 may include a durable sleeve 13 and a sloughable sleeve 16. In one embodiment of the invention, the durable sleeve 13 has a wall thickness of approximately 10 millimeters to 15 millimeters, a diameter D of approximately 80 millimeters to 90 millimeters, and the sloughable sleeve 16 has a wall thickness of approximately 7 millimeters to 11 millimeters.

The durable sleeve 13 may be a ceramic material, such as for example alumina or alumina-graphite. The durable sleeve 13 may have a first end 19 and a second end 22. The durable sleeve 13 may have an inner surface 25 defining a through-hole 28 extending from the first end 19 to the second end 22.

The sloughable sleeve 16 may be paperboard, such as cardboard. Alternatively, the sloughable sleeve 16 may be a ceramic blanket, either woven or non-woven. An example of a ceramic blanket is BTU-Block produced by Thermal Ceramics of Augusta, Ga. The sloughable sleeve 16 may define a channel 31 through which an additive 34 may be delivered. When molten metal or slag contacts such a sloughable sleeve 16, a portion of the sloughable sleeve 16 may burn or melt, depending on the material. When the sloughable sleeve 16 burns or melts, the molten metal or slag falls back into the molten metal bath 37, thereby preventing the molten metal and slag from sticking to the end-piece 110, which in turn prevents buildup of metal and slag.

The sloughable sleeve 16 may reside in the through-hole 28 of the durable sleeve 13 and may be attached to the durable sleeve 13. A bonding material 40, such as ceramic-mortar, may reside between the sloughable sleeve 16 and the durable sleeve 13 in order to secure the sloughable sleeve 16 to the durable sleeve 13. One ceramic-mortar that may be suitable is sold under the tradename "Super G 3000", which is available from Vesuvius USA Corp.

Figure 5:
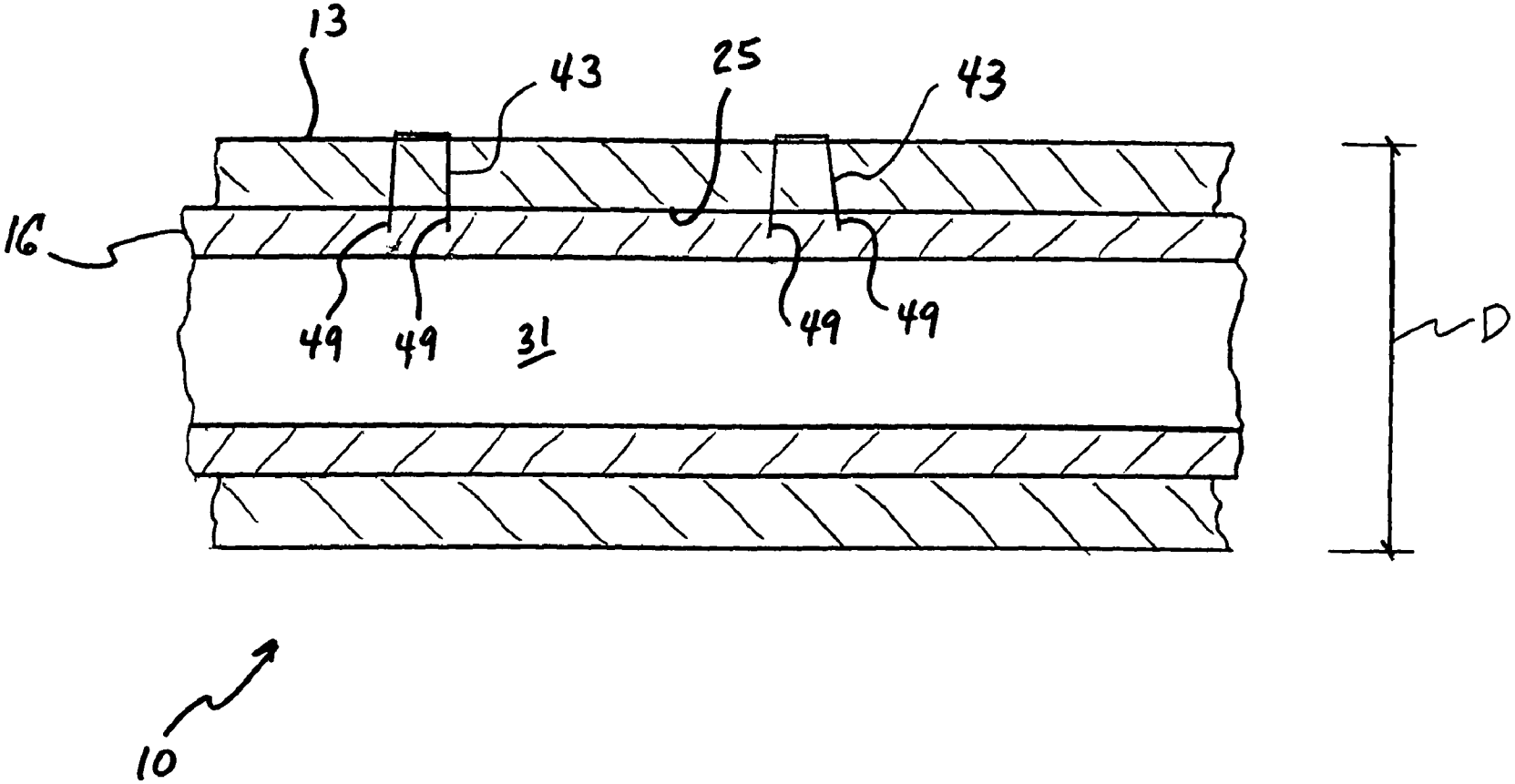
FIG. 5, which is a cross-sectional side view of an end-piece according to the invention.

In lieu of or in addition to the bonding material 40, a first fastener 43 may be used to secure the sloughable sleeve 16 to the durable sleeve 13. For example, the first fastener 43 may be a staple that extends from the durable sleeve 13 to the sloughable sleeve 16 in a manner such that the first fastener 43 secures the sloughable sleeve 16 to the durable sleeve 13. The first fastener 43 may extend through the durable sleeve 13. FIG. 5 shows the first fastener 43 extending through the durable sleeve 13 into the sloughable sleeve 16. In FIG. 5, the fastener 43 does not extend all the way through the sloughable sleeve 16.

Figure 6:
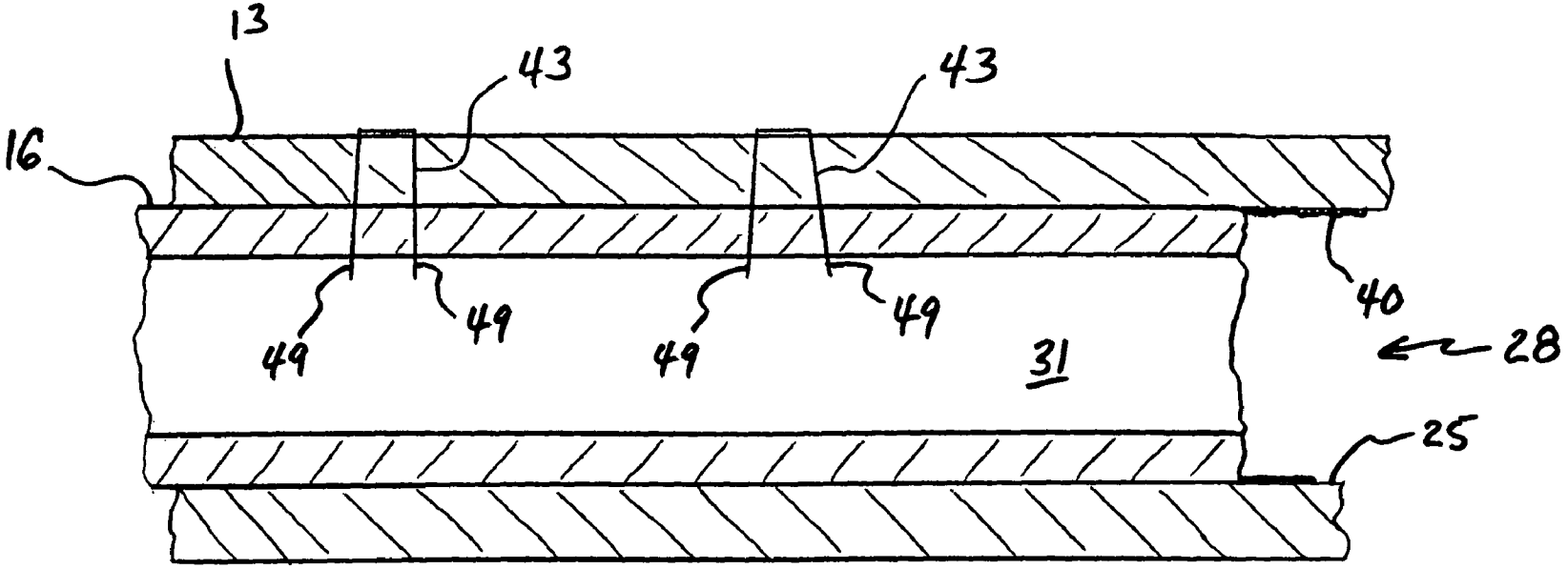
FIG. 6, which is a cross-sectional side view of an end-piece according to the invention.

FIG. 6 depicts another embodiment in which the first fastener 43 extends into the channel 31. When the guide tube 46 is inserted into the sloughable sleeve 16, the ends 49 of the fasteners 43 that protrude through the sloughable sleeve 16 will be bent by the guide tube 46. In such an arrangement, the ends 49 of the fasteners 43 may help secure the guide tube 46 to the sloughable sleeve 16.

Figure 7:
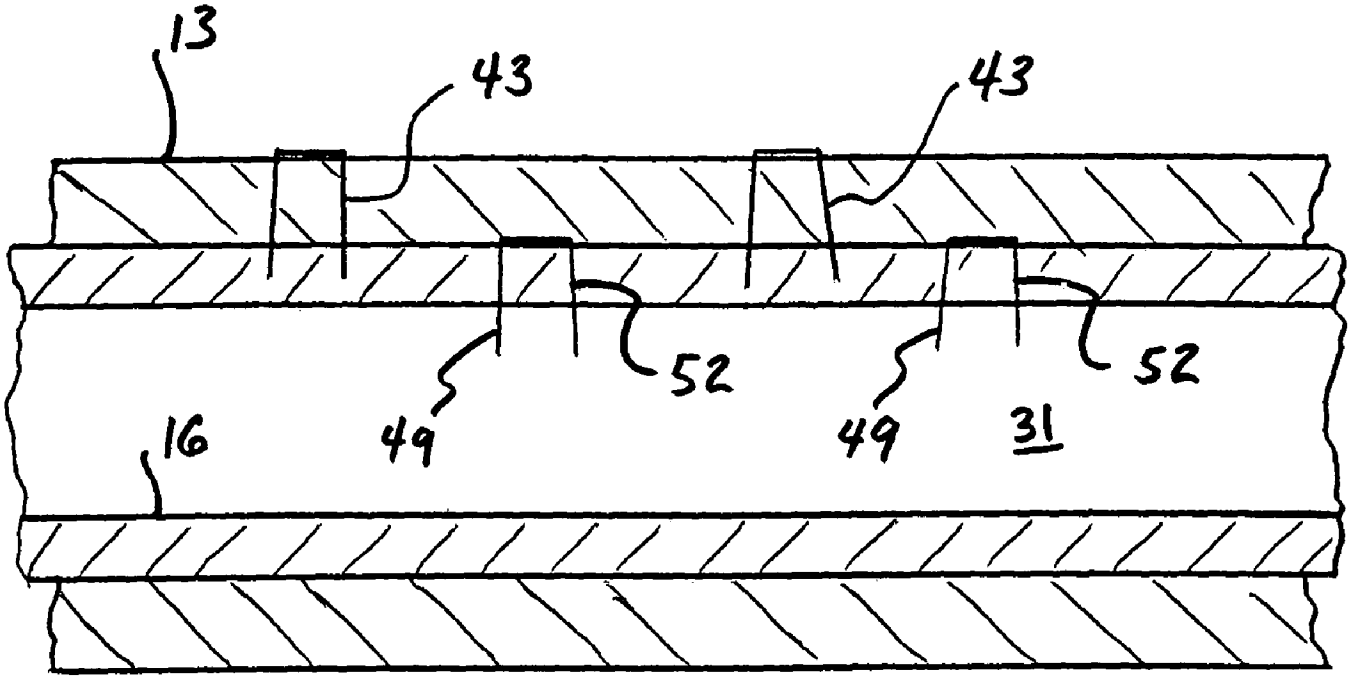
FIG. 7, which is a cross-sectional side view of an end-piece according to the invention.

A second fastener 52 may extend through the sloughable sleeve 16 but not the durable sleeve 13. FIG. 7 shows an example of such an arrangement. In FIG. 7 it will be noted that the first fastener 43 secures the durable sleeve 13 to the sloughable sleeve 16, and the ends 49 of the second fasteners 52 extend into the channel 31 in order to secure the guide tube 46 to the sloughable sleeve 16.

An end-piece 10 according to the invention may be used with an additive guide tube 46 to form an assembly 55. The guide tube 46 may be made from metal. The guide tube 46 may be positioned to reside in the channel 31, and may be secured to the sloughable sleeve 16 by first fasteners 43 and/or second fasteners 52 that extend from the sloughable sleeve 16 into the channel 31. Alternatively, or in addition, the guide tube 46 may be secured to the sloughable sleeve 16 by making the channel 31 a size that will provide a friction fit or an interference fit with the guide tube 46. When an interference fit is provided, the sloughable sleeve 16 may be compressed between the guide tube 46 and the durable sleeve 13. In this manner, the guide tube 46 may be fixed relative to the end-piece 10, without applying forces to the durable sleeve 13 that might fracture the durable sleeve 13. Furthermore, the sloughable sleeve 16 may protect the durable sleeve 13 from impacts, such as from the cored wire additive 34, and therefore may prevent fracturing of the durable sleeve 13.

Figure 3:
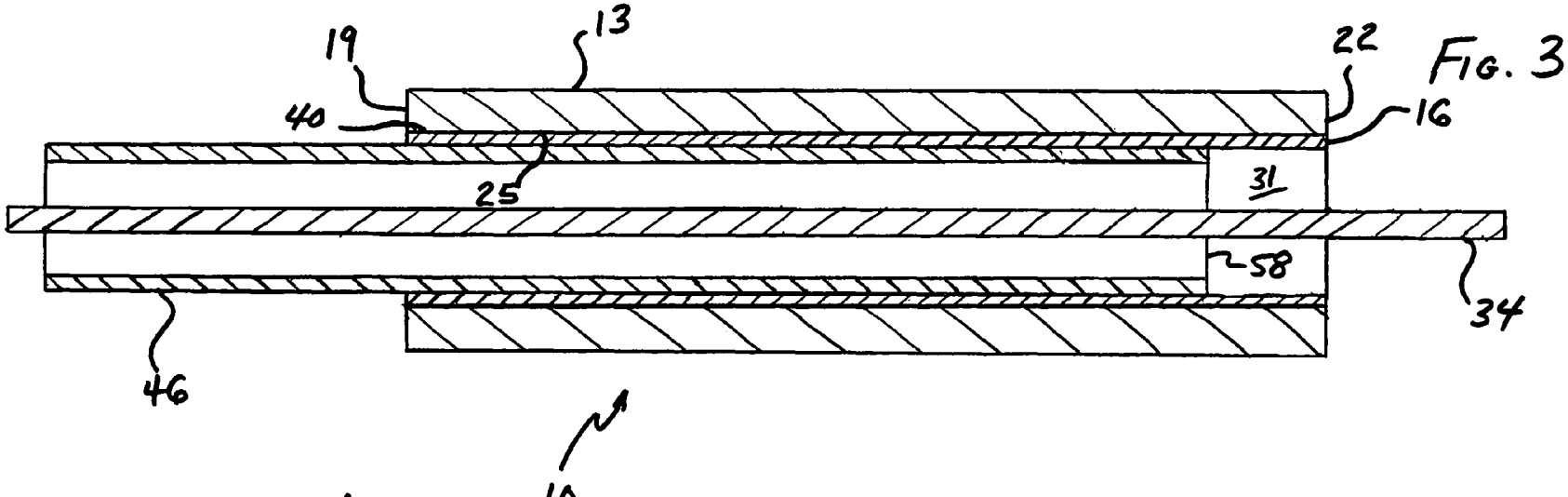
FIG. 3, which is a cross-sectional side view of an end-piece according to the invention.
Figure 4:
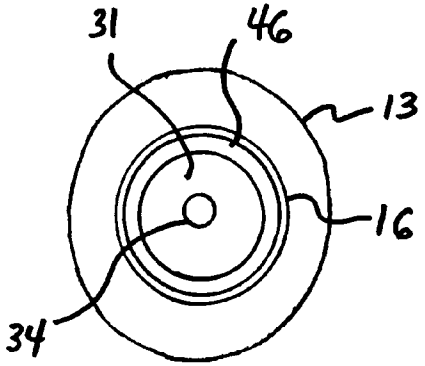
FIG. 4, which is an end view of the end-piece depicted in FIG. 3.

In this arrangement, the first end 19 of the durable sleeve 13 may be considered a receiving end, and the second end 22 of the durable sleeve 13 may be considered a dispensing end. The guide tube 46 may be received in the receiving end 19, and the additive 34 may be dispensed through the dispensing end 22. The dispensing end 22 of the durable sleeve 13 may extend beyond a dispensing end 58 of the guide tube 46. In this manner, the durable sleeve 13 may serve to protect the guide tube 46 from molten metal and slag that may splash in the vicinity of the guide tube 46. When used near a molten metal bath 37, the durable sleeve 13 and guide tube 46 may be positioned relative to each other so that the dispensing end 22 of the durable sleeve 13 will be closer to the molten metal bath 37 than the dispensing end 58 of the guide tube 46. The relative position of the durable sleeve 13 and guide-tube 46 of an embodiment of the invention is best seen in FIG. 3.

FIG. 1 shows an embodiment of the invention being used near a molten metal bath 37. The end-piece 10 may allow the guide tube 46 to be placed close to the molten metal bath 37, which in turn may enhance the recovery of additives 34, including alloys injected in molten metal via wire feeding methods. The portion of the sloughable sleeve 16 that extends beyond the end 58 of the guide tube 46 may encounter molten metal. When molten metal contacts the sloughable sleeve 16, the sloughable sleeve 16 burns or melts and sloughs off, thereby preventing the molten metal from sticking to the end-piece 10, which in turn prevents buildup of metal and slag.

Figure 8:
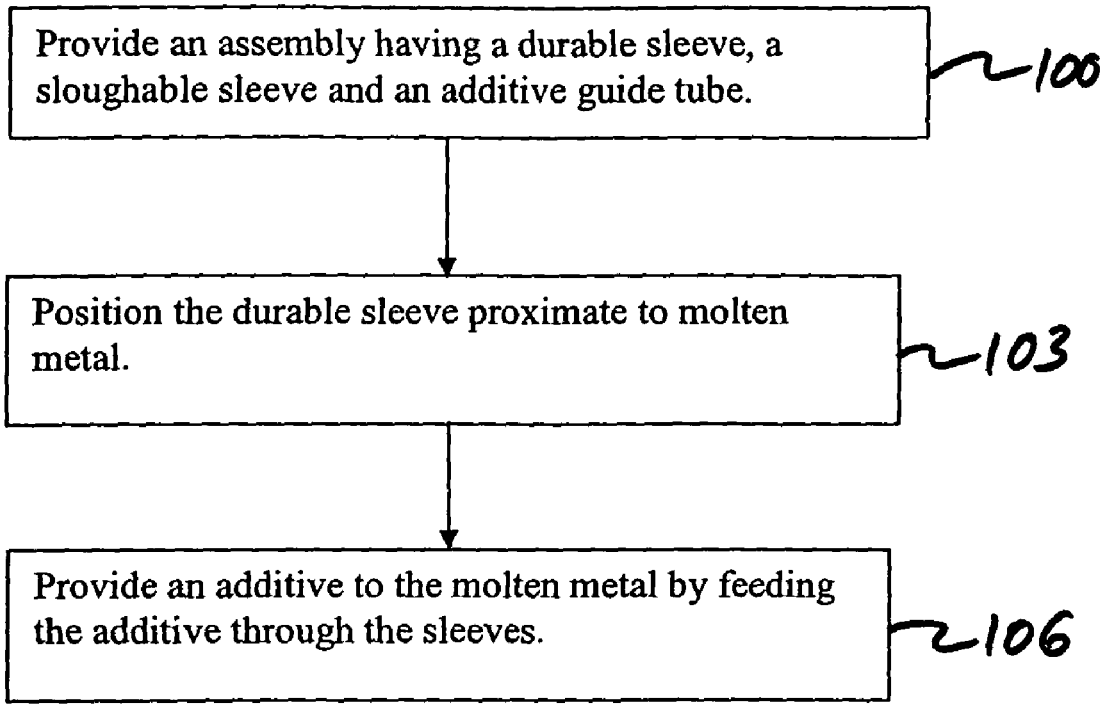
FIG. 8, which is a flow chart depicting a method according to the invention.

The invention may be embodied as a method of dispensing an additive. FIG. 8 depicts one such method in which a guide-tube assembly is provided 100. The guide tube assembly may have a durable sleeve, a sloughable sleeve and an additive guide tube, such as those described above. The durable sleeve and the sloughable sleeve may be arranged relative to the guide tube so that dispensing ends of the durable sleeve and sloughable sleeve extend beyond a dispensing end of the guide tube, and in this manner the dispensing ends of the durable sleeve and the sloughable sleeve may be placed closer to a molten metal bath than a dispensing end of the guide tube. The durable sleeve and sloughable sleeve may be positioned 103 proximate to molten metal, and an additive may be provided 106 to the molten metal by feeding the additive through the sleeves from the receiving end toward the dispensing end, and finally into the molten metal.

U.S. provisional patent application No. 60/658,660 discloses additional details about the invention and additional embodiments of the invention. The disclosure of that patent application is incorporated by this reference.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A method of dispensing an additive to a metal, comprising:

providing a guide-tube assembly having:

(a) a durable sleeve having a receiving end and a dispensing end, and having an inner surface defining a through-hole extending from the receiving end to the dispensing end, the durable sleeve being made from a first material;

(b) a sloughable sleeve having an end and a channel, the sloughable sleeve residing in the through-hole of the durable sleeve and being secured to the durable sleeve, the sloughable sleeve being made from a second material;

(c) an additive guide tube residing in the channel of the sloughable sleeve and being secured to the sloughable sleeve, and both the durable sleeve and the sloughable sleeve are arranged relative to the guide tube so that the dispensing end of the durable sleeve and the end of the sloughable sleeve extend beyond a dispensing end of the guide tube;

positioning the durable sleeve proximate to molten metal;

providing an additive wire to the molten metal by feeding the additive wire through the sleeves from the receiving end toward the dispensing end, and into the molten metal.

2. The method of claim 1, further comprising providing an additive to the molten metal by feeding the additive through the sleeves from the receiving end toward the dispensing end.

* * * * *